US007681867B2

(12) United States Patent
Hu et al.

(10) Patent No.: US 7,681,867 B2
(45) Date of Patent: Mar. 23, 2010

(54) DIFFUSER FOR AN AERATION SYSTEM

(75) Inventors: Yen-Jung Hu, Tainan-Hsien (TW); Huang-Chin Pan, Tainan Hsien (TW)

(73) Assignee: Kang Na Hsiung Enterprise Co., Ltd. (TW)

( * ) Notice: Subject to any disclaimer, the term of this patent is extended or adjusted under 35 U.S.C. 154(b) by 0 days.

(21) Appl. No.: 12/141,994

(22) Filed: Jun. 19, 2008

(65) Prior Publication Data

US 2009/0102075 A1 Apr. 23, 2009

(30) Foreign Application Priority Data

Oct. 18, 2007 (TW) ..... 96139012 A

(51) Int. Cl.
*B01F 3/04* (2006.01)

(52) U.S. Cl. ..... 261/62; 261/122.1

(58) Field of Classification Search ..... 261/62, 261/122.1, 122.2, 124; 210/150, 151, 220, 210/221.1, 221.2
See application file for complete search history.

(56) References Cited

U.S. PATENT DOCUMENTS 4,848,749 A * 7/1989 Schneider ..... 261/62
5,330,688 A 7/1994 Downs
5,422,043 A * 6/1995 Burris ..... 261/122.1
5,705,063 A * 1/1998 Lee ..... 210/220
5,858,283 A * 1/1999 Burris ..... 261/122.1
6,145,817 A * 11/2000 Jager et al. ..... 261/122.2
6,367,783 B1 * 4/2002 Raftis ..... 261/122.1
6,645,374 B2 * 11/2003 Cote et al. ..... 210/151
7,044,453 B2 * 5/2006 Tharp ..... 261/122.1
7,243,912 B2 * 7/2007 Petit et al. ..... 261/122.2
2005/0184408 A1 * 8/2005 Petit et al. ..... 261/122.1

FOREIGN PATENT DOCUMENTS

EP 229386 A1 * 7/1987 ..... 261/122.2

* cited by examiner

*Primary Examiner*—Richard L Chiesa
(74) *Attorney, Agent, or Firm*—Bliss McGlynn, P.C.

(57) ABSTRACT

This invention relates to a diffuser for an aeration system, including a base, a diaphragm and a valve member attached to the diaphragm. The base is provided with a valve seat for engaging with the valve member to close the inlet of the aerating gas. Furthermore, the diaphragm includes a central portion, a peripheral portion attached to the periphery of the base, and a surrounding web segment interposed therebetween. The surrounding web segment includes a plurality of fibrous filaments which are arranged to form a textured structure with a plurality of pores of a dimension such that the aerating gas, when introduced, is permitted to be bubbled through the plurality of pores, so as to form fine and small bubbles in the water.

9 Claims, 8 Drawing Sheets

DIFFUSER FOR AN AERATION SYSTEM

CROSS-REFERENCE TO RELATED APPLICATION

This application claims priority from Taiwanese Application No. 96139012, filed on Oct. 18, 2007.

BACKGROUND OF THE INVENTION

1. Field of the Invention

The invention relates to a diffuser for an aeration system, and more particularly to a diffuser which allows gas introduced in the aeration system to form small and fine bubbles, so as to increase the concentration of a gas, such as oxygen, that is dissolved in a water pool equipped with the aeration system.

2. Description of the Related Art

In order to establish an aerobic condition commonly used in the treatment of wastewater or sewage, or in the cultivation of biological materials in water pools, an aeration system is employed to increase the oxygen concentration in water.

An aeration system includes a plurality of diffusers adapted to be provided on the bottom of a water pool, conduits connected to the plurality of diffusers, and a blower forcing air to flow into the conduits and to pass through the slits provided in the diffusers, so as form a plurality of bubbles in the water pool.

As shown in FIG. 1, U.S. Pat. No. 5,330,688 discloses a diffuser, which comprises a disk-shaped base 92 connected to a conduit 91 and a disk-shaped membrane diffuser 93 provided on the base 92. With reference to FIG. 2, the disk-shaped membrane diffuser 93, which is made of an elastomeric material, is provided with a plurality of slits 94, which are spaced apart from each other and arranged circularly, to allow the passage of air introduced from the conduit 91 through the slits of the membrane diffuser 93 to form bubbles in the water of a water pool. In order to increase the concentration of the dissolved gas in the water, the slits 94 of the membrane diffuser 93 are as small as possible and are provided at a density that is as high as possible. However, since the elastomeric material is tough and since the membrane diffuser 93 must possess a tensile strength that is sufficient to resist the pressure within a chamber defined by the base 92 and the diffuser membrane 93 when gas is introduced into the chamber, limits are encountered with respect to how small the slits 94 can be made and to how high a density the slits 94 of the elastomeric membrane diffuser 93 can be provided.

The commercially available membrane diffuser for aeration systems is generally made from an elastomeric material of a synthetic rubber, such as ethylene-propylene-diene monomer rubber (EPDM) rubber and a thermoplastic elastomer (TPE), the slits of which are generally millimeter-sized.

SUMMARY OF THE INVENTION

An object of the present invention is to provide a diffuser for an aeration system which overcomes the disadvantages encountered with the aforesaid prior art.

Another object of the present invention is to provide a diffuser for an aeration system that increases the dissolved gas concentration in a water pool.

According to one aspect, the present invention provides a diffuser for an aeration system, comprising a base which has a major wall with a periphery, and which defines a central line that is normal to the major wall, the major wall having an outer major surface and an inner major surface which is opposite to the outer major surface, and which defines an inlet that is adapted to introduce thereinto an aerating gas from the aeration system to generate a back pressure, and that extends along the central line through the outer major surface to form thereon a valve seat;

a valve member configured to engage the valve seat so as to close the inlet; and a diaphragm including, a central portion disposed to carry the valve member to place the diaphragm in a non-aerating position when the inlet is closed, a peripheral portion which surrounds the central portion, and which is secured to the periphery to form upstream and downstream sides separated by the diaphragm such that, when the back pressure at the upstream side is higher than an ambient pressure at the downstream side, the valve member is forced to move away from the valve seat to place the diaphragm in an aerating position, and a surrounding web segment which is interposed between the central portion and the peripheral portion, and which is configured to stay in abutment with the outer major surface in the non-aerating position, the surrounding web segment including a plurality of fibrous filaments which are arranged to form a textured structure with a plurality of pores of a dimension such that in the aerating position, the introduced aerating gas is permitted to be bubbled through said plurality of pores, and such that the abutment of the surrounding web segment with the outer major surface is sufficient to institute a barrier to guard against a back flow through each one of the pores immediately after the back pressure is set to drop below the ambient pressure.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
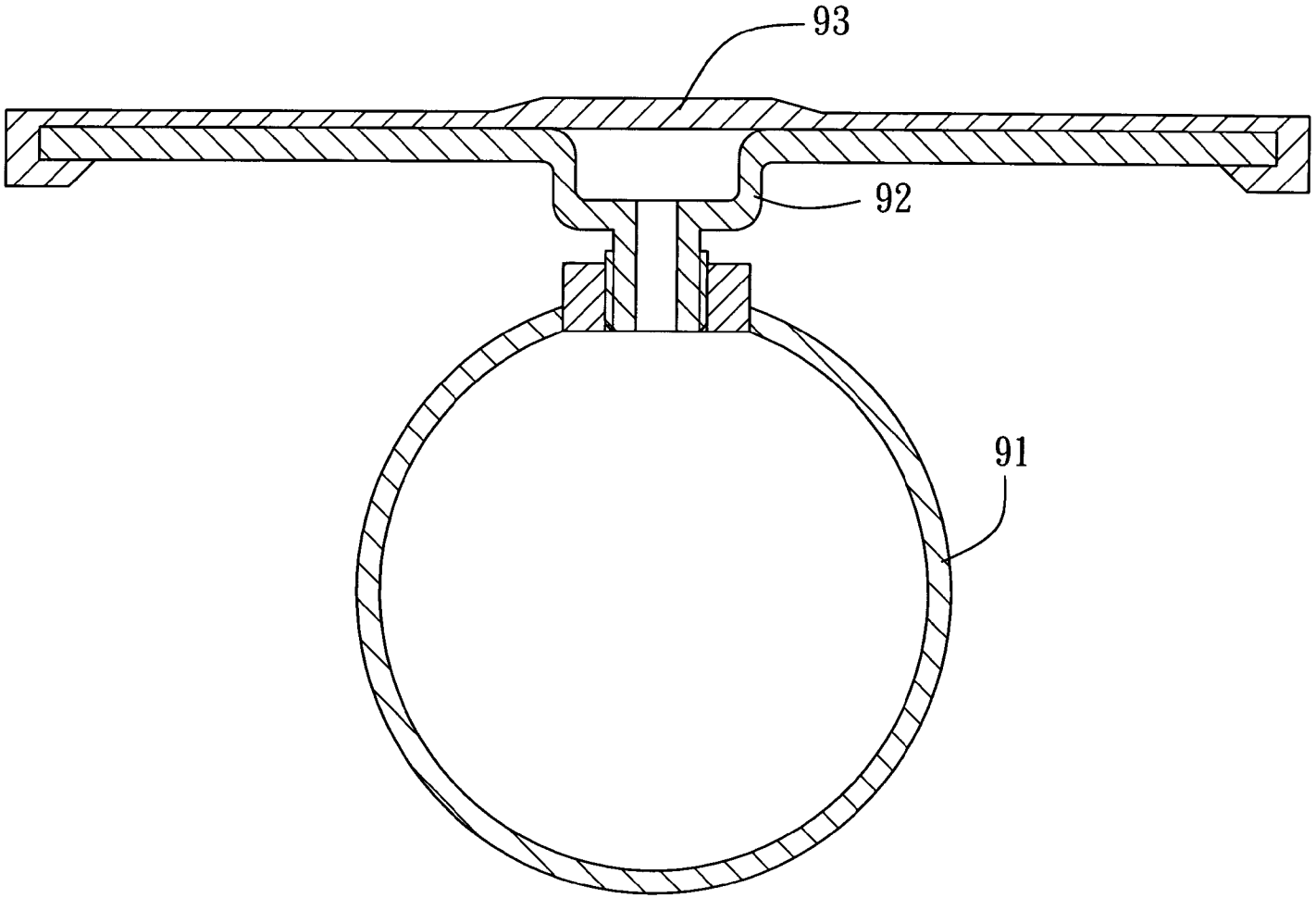
FIG. 1 PRIOR ART
FIG. 1 is a schematic view of a conventional diffuser for an aeration system.
Figure 2:
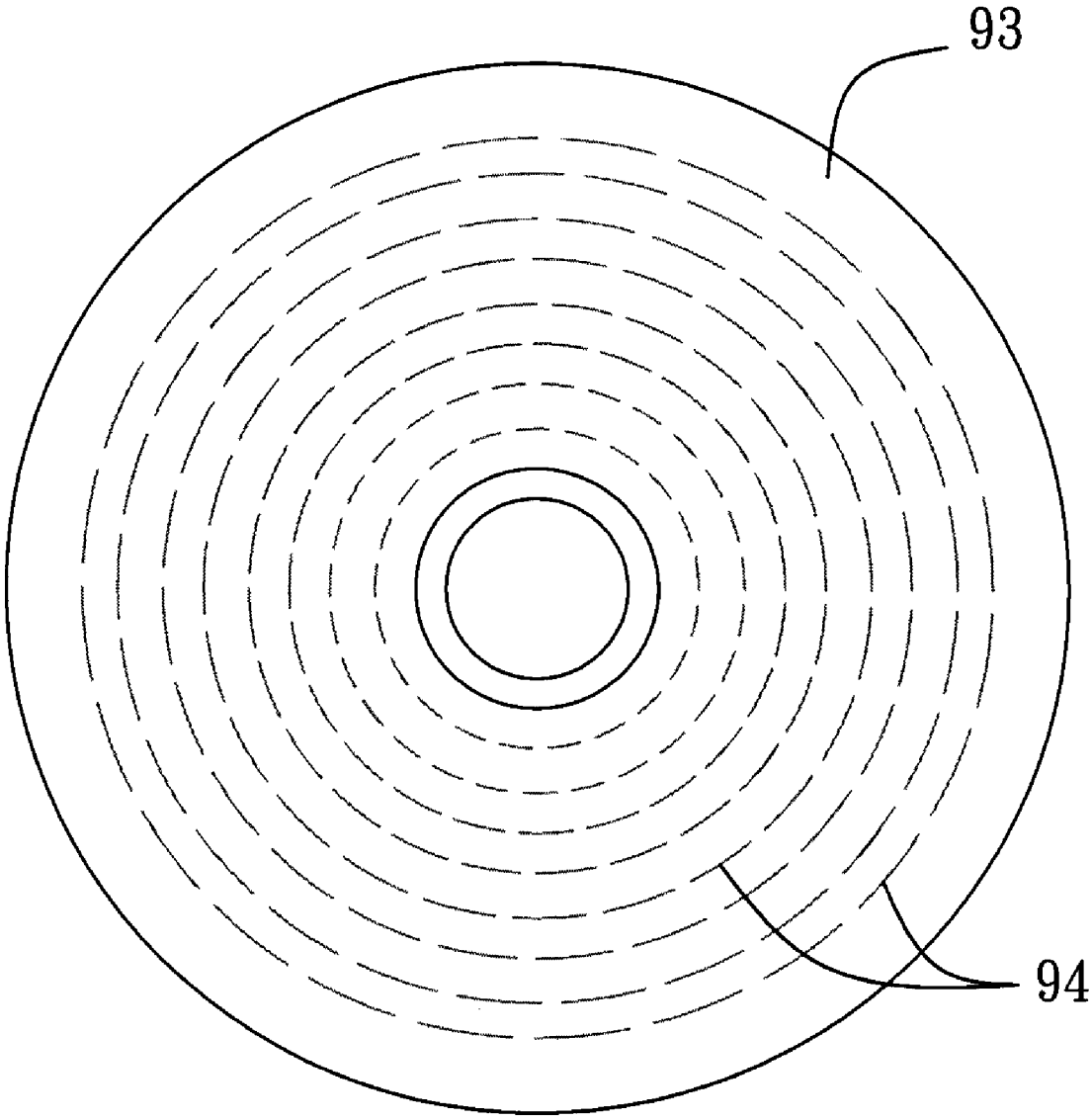
F I G. 2 PRIOR ART
FIG. 2 is a schematic view of a conventional membrane in the diffuser of FIG. 1.
Figure 3:
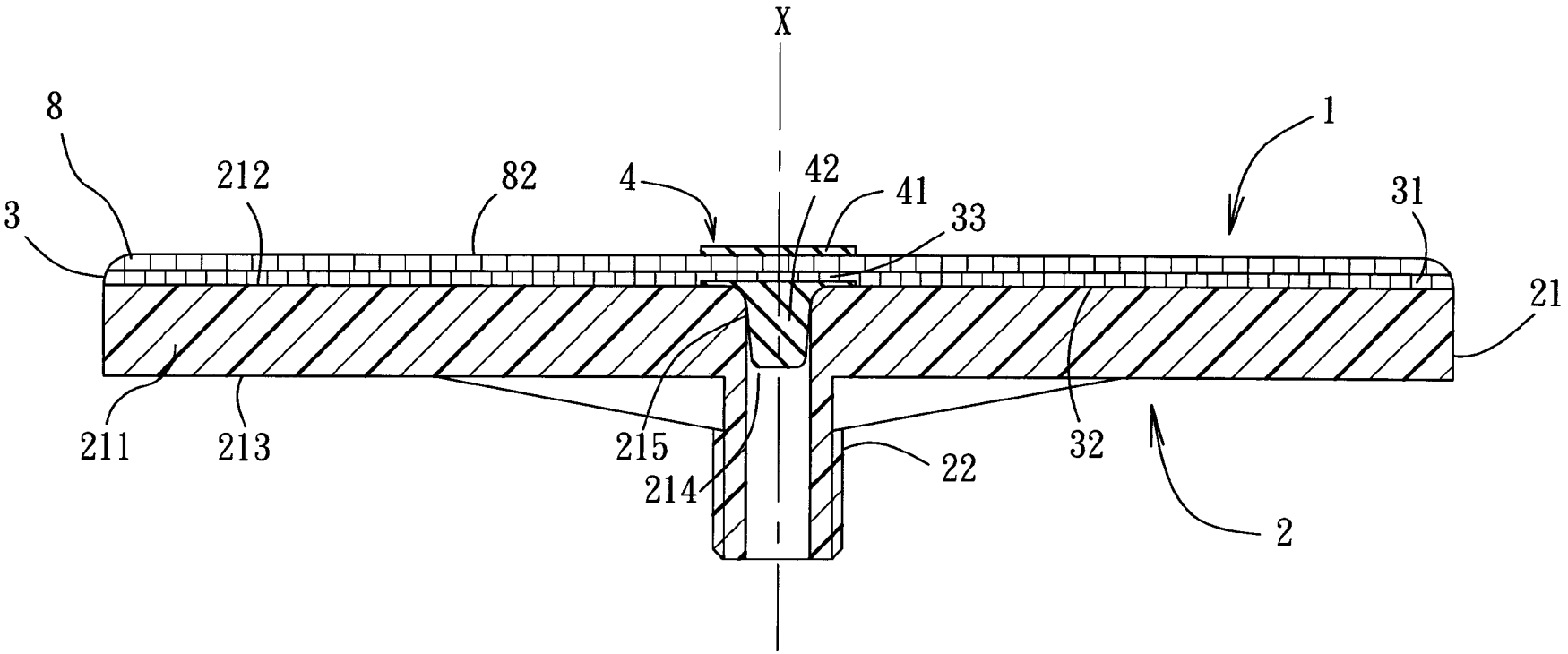
FIG. 3 is a sectional view of a diffuser of the first embodiment of the present invention in a non-aeration position.
Figure 4:
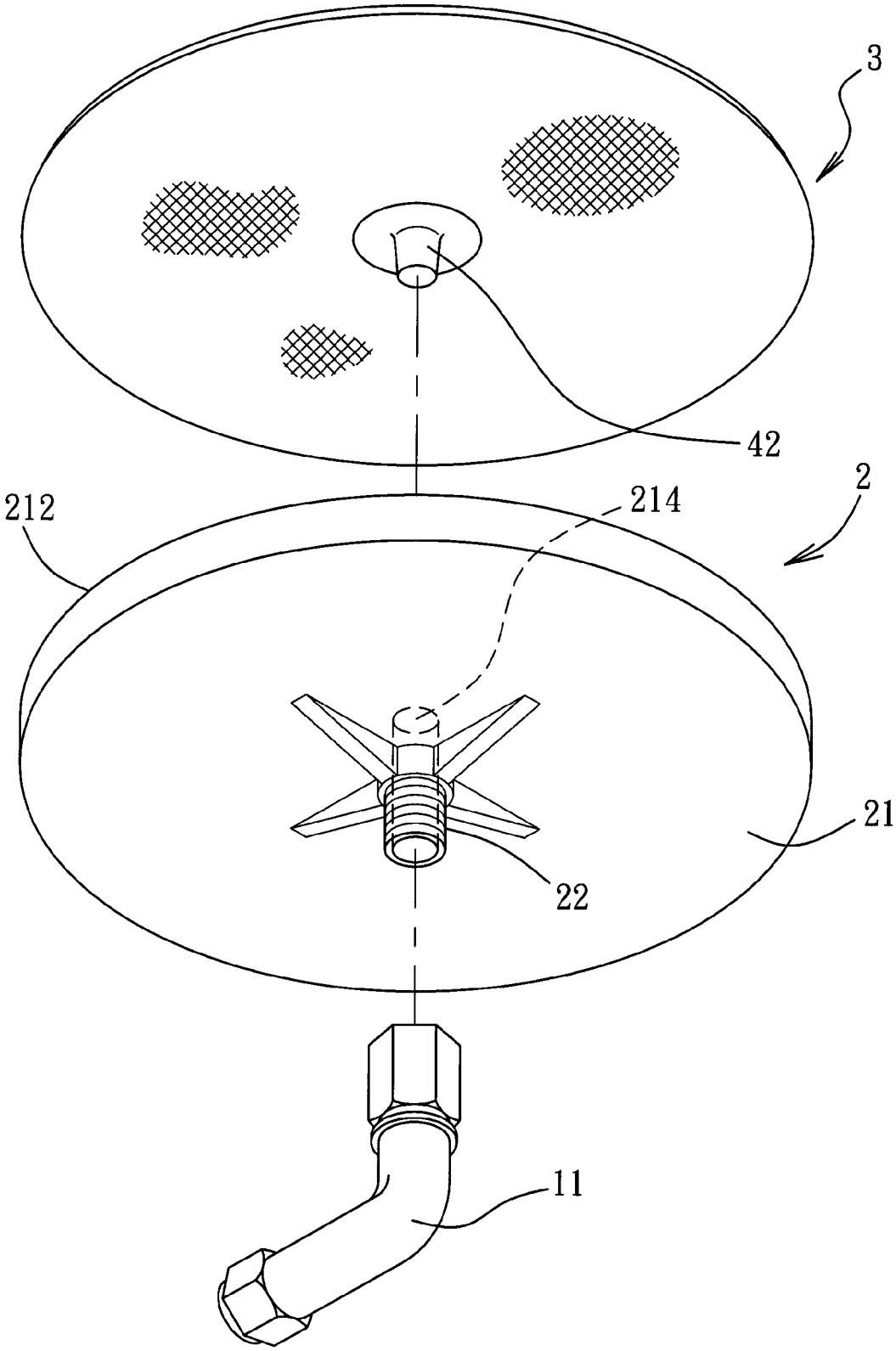
FIG. 4 is an exploded perspective view of the diffuser of the first embodiment and a conduit of an aeration system.
Figure 5:
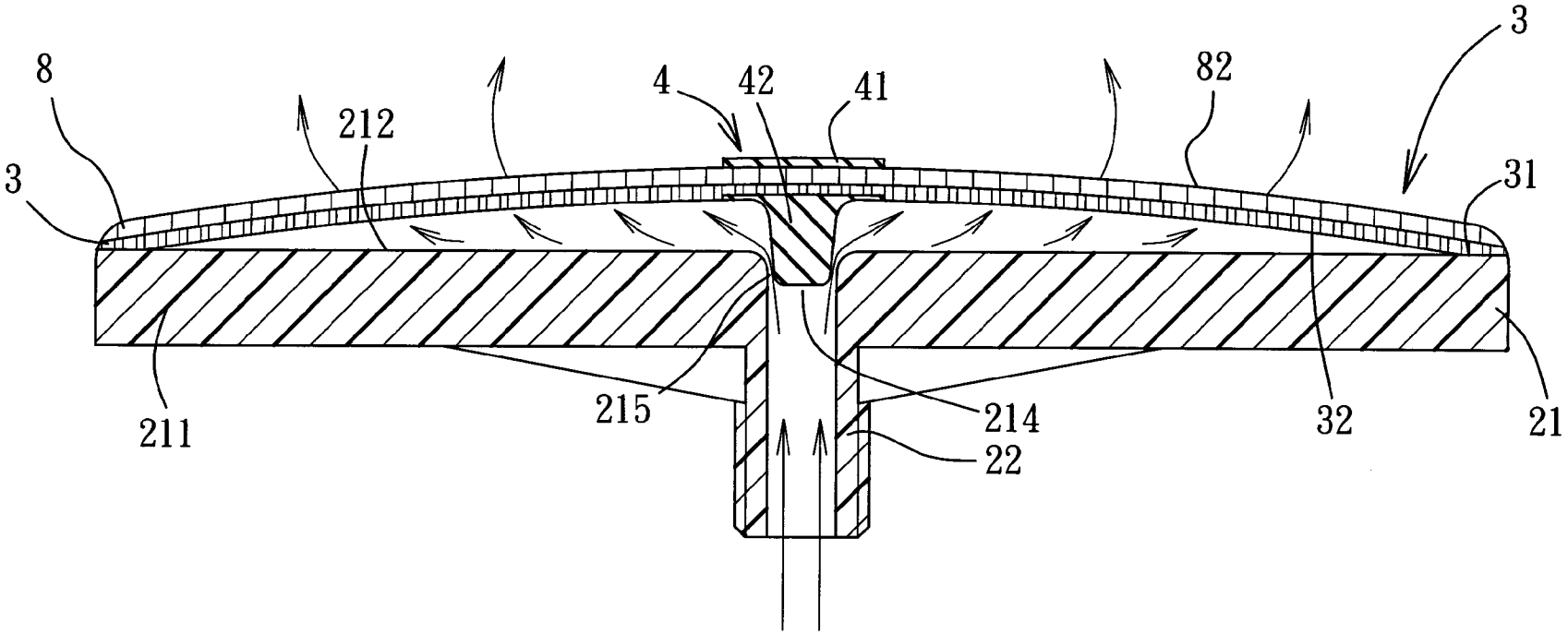
FIG. 5 is a sectional view of the diffuser of the first embodiment of this invention in an aeration position.

The first embodiment of a diffuser 1 for an aeration system is illustrated in FIGS. 3, 4 and 5. The diffuser 1 of the first embodiment of the present invention comprises a base 2, a valve member 4 and a diaphragm 3. The base 2 has a major wall 21 with a periphery 211 and defines a central line X that is normal to the major wall 21. The major wall 21 has an outer major surface 212 and an inner major surface 213 which is opposite to the outer major surface 212. The major wall 21 also defines an inlet 214 that is adapted to introduce thereinto an aerating gas from the aeration system to generate a back pressure. The inlet 214 extends along the central line X through the outer major surface 212 to form thereon a valve seat 215. The base 2 may further have a conduit portion 22 which is extended from the inner major surface 213 along the central line X and which is in fluid communication with the inlet 214 for the introduction of an aerating gas from a conduit 11 of the aeration system into the inlet 214. In order to allow the diffuser 1 to be easily replaced, the conduit portion 22 of the base 2 is threaded so as to allow for detachable engagement of the conduit 11 of the aeration system to the base 2, as shown in FIG. 4.

The valve member 4 is configured to close the inlet 214. To be specific, the valve member 4 comprises a head portion 41 and a stem portion 42 which extends along the central line X and can close the inlet 214 by engaging with the valve seat 215. The diaphragm 3 is placed between the head portion 41 and the stem portion 42 and is pressed therebetween. Preferably, the valve member 4 is made of a waterproof elastomeric material, such as polyurethane, so that the valve member 4 can be adhered to the diaphragm 3. The diaphragm 3 of the diffuser 1 of the first embodiment of this invention includes a central portion 33, a peripheral portion 31 and a surrounding web segment 32. The central portion 33 is disposed to carry the valve member 4 to place the diaphragm 3 in a non-aerating position when the inlet 214 is closed. The peripheral portion 31 surrounds the central portion 33, and is secured to the periphery 211 to form upstream and downstream sides separated by the diaphragm 3 such that, when the back pressure at the upstream side is higher than an ambient pressure at the downstream side, the valve member 4 is forced to move away from the valve seat 215 to place the diaphragm 3 in an aerating position.

The surrounding web segment 32, which is interposed between the central portion 33 and the peripheral portion 31, is configured to stay in abutment with the outer major surface 212 in the non-aerating position. The surrounding web segment 32 includes a plurality of fibrous filaments which are arranged to form a textured structure with a plurality of pores of a dimension such that, in the aerating position, the introduced aerating gas can be bubbled through the plurality of pores, and such that the abutment of the surrounding web segment 32 with the outer major surface 212 can sufficiently institute a barrier to guard against a back flow through each one of the pores immediately after the back pressure is set to drop below the ambient pressure.

The fibrous filaments of the surrounding web segment 32 have a diameter in the range of 0.005 μm to 5 μm, and the formed textured structure is a non-woven structure which has a basis density in the range of 20-150 g/cm$^2$, and which has said plurality of pores with a mean size ranging from 1 to 20 μm, preferably ranging from ranging from 5 to 12 μm.

In a preferred embodiment, the diffuser 1 further comprises a reinforcement layer 8 which is disposed to shield the diaphragm 3 from the back pressure. The reinforcement layer 8 has an auxiliary web segment 82 that is configured to be superimposed upon the surrounding web segment 32 and that includes a plurality of macro-pores of such a dimension as not to interfere with the bubbling of the introduced aerating gas through the plurality of pores of the surrounding web segment 32. The surrounding web segment 32 and the auxiliary web segment 82 are made of fibers with different diameters. The auxiliary web segment 82 of the reinforcement layer 8 is made from a non-woven fabric which has a basis density in the range of 20-150 g/cm$^2$, and which has said plurality of macro-pores with a mean size ranging from 8 to 100 μm, preferably ranging from 10 to 30 μm. The non-woven fabric is made of a fiber having a diameter in the range of 10 μm to 200 μm. Due to the specific arrangement of the surrounding web segment 32 and the auxiliary web segment 82, the radial diffusion of the aerating air from the central portion of the base 2 can be enhanced, and the formation of the fine air bubbles and the air dissolved in water can be increased.

The surrounding web segment 32 may be a non-woven fabric made from any suitable material, including, but not limited to, polyester, polyproprylene and polyethylene. Furthermore, the non-woven fabric may be formed of a single-layered or multilayered structure.

The auxiliary web segment 82 of the reinforcement layer 8 has a tensile strength greater than that of the surrounding web segment 32, so as to shield the surrounding web segment 32 of the diaphragm 3 from the back pressure. The reinforcement layer 32 may be made of any material suitable for the formation of woven and non-woven fabrics, including, but not limited to, polyester, polyproprylene, and polyethylene. When a non-woven fabric is used as the reinforcement layer 82, the non-woven fabric is preferably a spunbonded fabric of a single-layered or multilayered structure.

It is preferable that the reinforcement layer 8, which is a spunbonded fabric in the first embodiment, is adhered to the diaphragm 3, which is a non-woven fabric made by melt-blowing in the first embodiment, by a thermopress process, and the peripheral portion 31 of the diaphragm 3 together with the reinforcement layer 8 are attached to the periphery 211 of the base 2 by an ultrasound process. Accordingly, the diffuser 1 of the first embodiment can be easily manufactured by thermopress and ultrasound processes.

Figure 6:
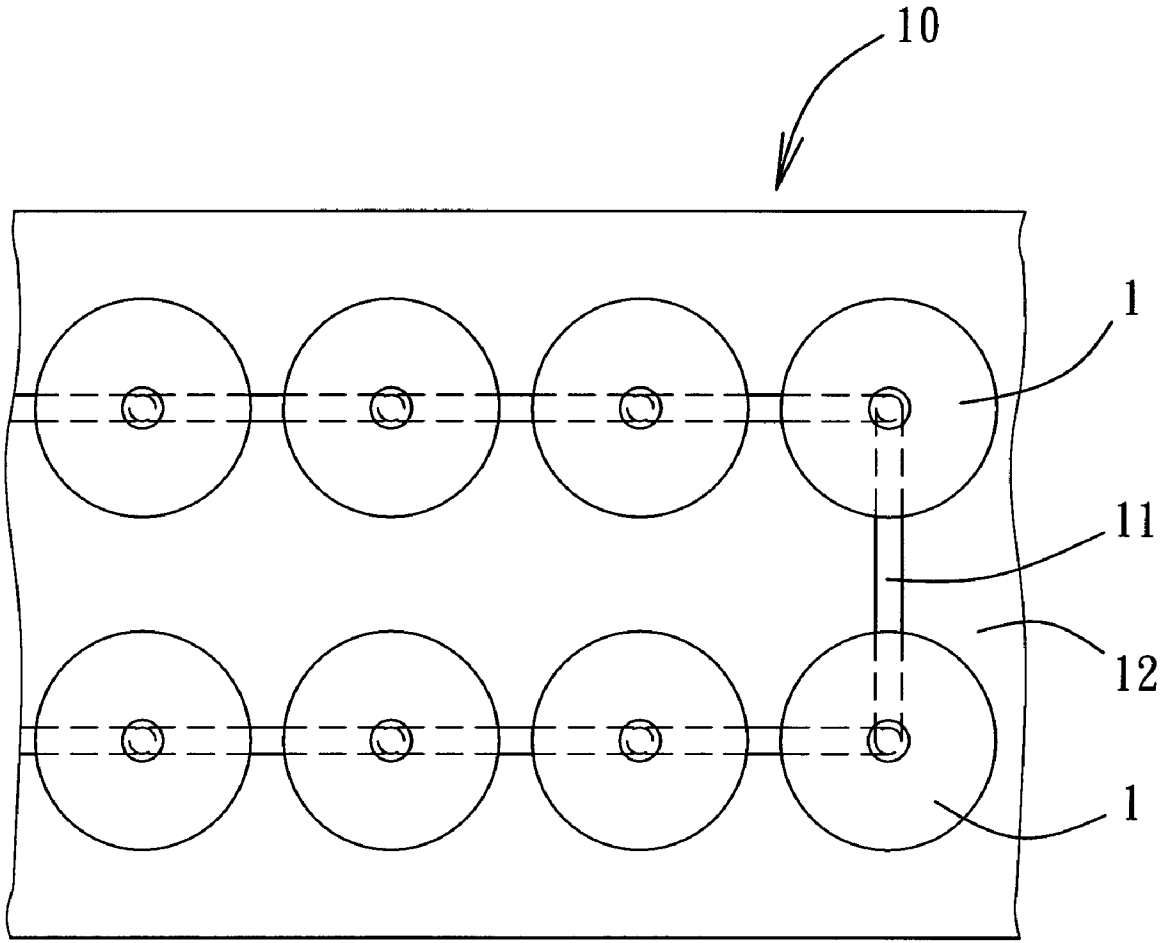
FIG. 6 is a schematic view of the application of a plurality of diffusers of the first embodiment into an aeration system.

With reference to FIG. 6, a plurality of the diffusers 1 of the first embodiment can be connected to conduits 11 of an aeration system 10, which is equipped in the bottom 12 of a pool for the treatment of wastewater or sewage, or for the cultivation of biological materials in water pools. A blower (not shown) is connected to the conduits 11 to allow an aerating gas (such as air) to flow into the conduits 11.

For each of the diffusers 1, when no air is supplied from the conduits 11, the valve member 4 is positioned in the non-aerating position and the valve member 4 is seated on the vale seat 215 to close the inlet 214. The surrounding web segment 32, which is in the non-aerating position, stays in abutment with the outer major surface 212, as shown in FIG. 3. When air is introduced from the conduits 11, the back pressure in the space defined between the diaphragm 3 and the base 2 will become higher than the ambient pressure at the downstream side, and in turn, force the valve member 4 to move away from the valve seat 215 and to place the diaphragm 3 in an aerating position, i.e., the valve member 4 and the surrounding web segment 32 move away from the valve seat 215 and the outer major surface 212, respectively. The aerating gas then bubbles through the plurality of pores of the surrounding web segment 32, as shown in FIG. 5. Because of the small mean micropores provided in the surrounding web segment 32, the radial diffusion of the aerating air from the central portion of the base 2 can be enhanced and the formation of fine bubbles can be increased. As a result, the dissolved oxygen concentration in the pool can increase.

Figure 7:
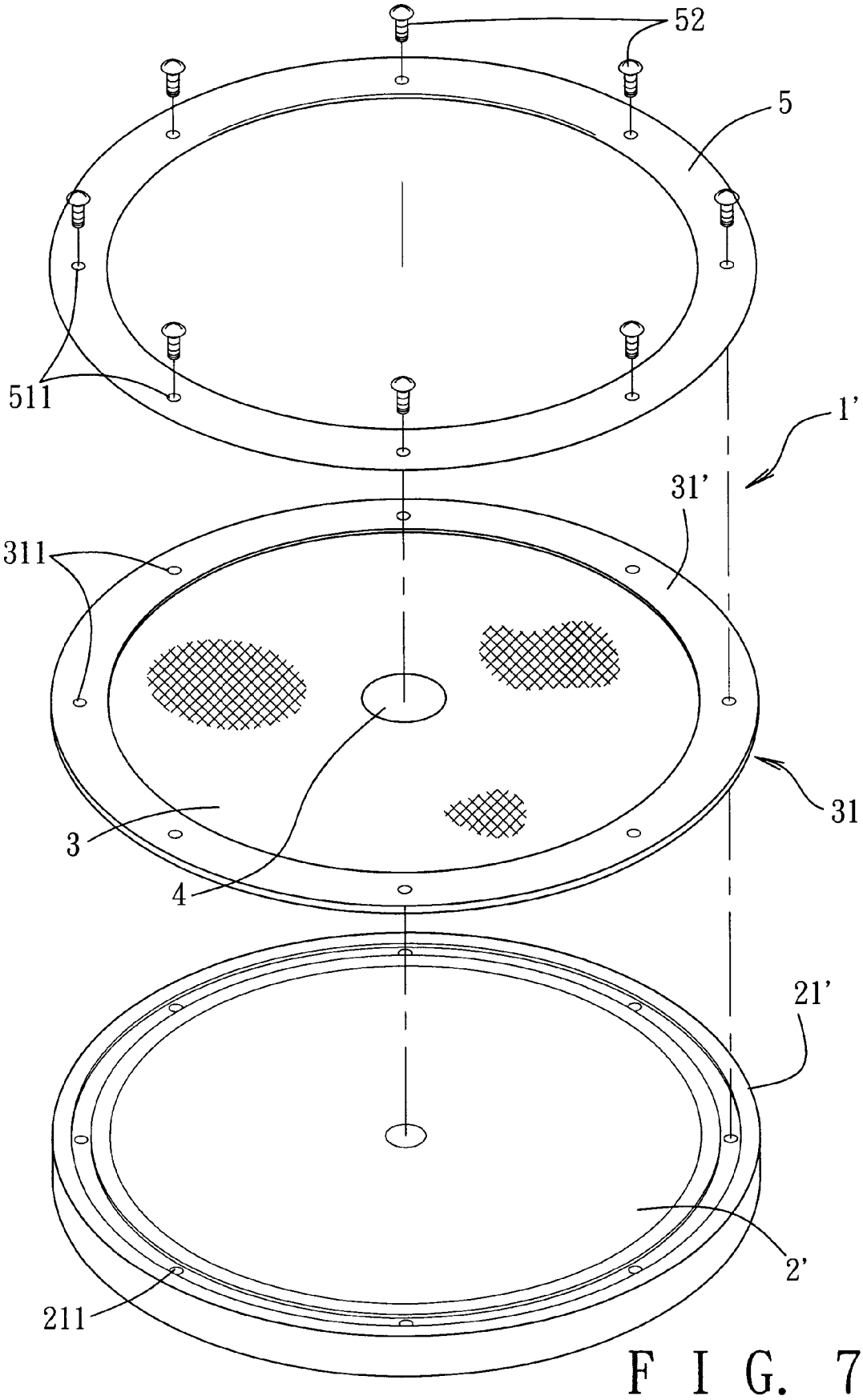
FIG. 7 is an exploded perspective view of a diffuser of the second embodiment of the present invention.
Figure 8:
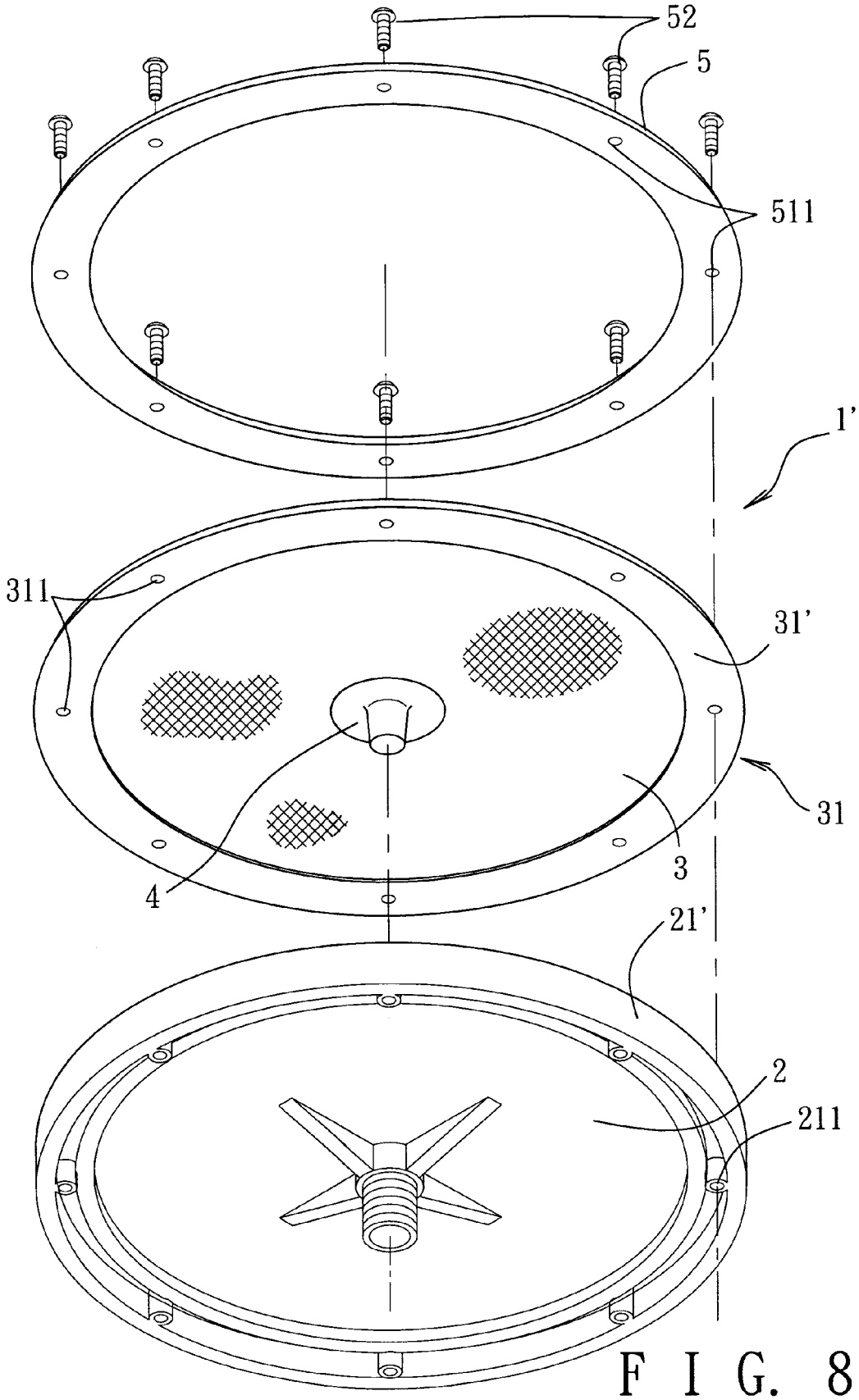
FIG. 8 is another exploded perspective view of the diffuser of the second embodiment of the present invention.

As shown in FIGS. 7 and 8, the diffuser 1' of the second embodiment of this invention is identical to that of the first embodiment except that the peripheral portion 31 of the diaphragm 3 includes an annular frame 31' which is made from a stiff material such that the surrounding web segment 32 is maintained in a state of tension through connection with the annular frame 31'. Further, the diffuser 1' according to the second embodiment of this invention comprises a securing ring 5 which is configured to mate with and secure the annular frame 31' to the periphery 21' of the base 2 via a plurality of screws 52, a plurality of screw holes 511 in the securing ring 5, a plurality of screw holes 311 in the annular frame 31' and a plurality of screw holes 211 in the periphery 21' of the base 2'. Furthermore, the peripheral portion 31' of the diaphragm 3 can be coated with a waterproof elastomeric material, such as polyurethane, so as to enhance the air-sealing attachment amongst the securing ring 5, the annular frame 31' and the periphery 21' of the base 2.

Experiment on Dissolved Oxygen Concentration

This experiment was carried out using the diffuser 1 of the first embodiment of this invention ("Example"). The diaphragm 3 was made from a non-woven fabric material made of a polypropylene fiber a diameter of 3±2 μm by melt blowing, and which had a basis weight of 60 g/m$^2$ and an average pore size of 7.5 μm. The reinforcement layer 8 was made from a spunbonded non-woven fabric material made of a PET fiber having a diameter of 15±5 μm, and which had a basis weight of 220 g/m$^2$ and an average pore size of 11 μm. The diaphragm 3 and the reinforcement layer 8 were bonded to each other by a thermopress process and then attached to the periphery 211 of the disk-shaped base 2 having a diameter of about 30 cm. Further, a diffuser of Model Disc-300, which is commercially available from Kai-Shing Incorporation, is made of EPDM rubber, and includes a disk-shaped base having a diameter of 30 cm, was employed in the Comparative example. The properties of the diffusers are set forth in the Table 1.

TABLE 1

| | Example | | Comparative |
|---|---|---|---|
| | Diaphragm layer (PP) | Reinforcement layer (PET) | example EPDM rubber |
| Non-woven Fabric | Yes | Yes | |
| Basis weight (g/cm$^2$) | 60 | 220 | — |
| Pore size (μm) | 7.5 | 11 | 750 ± 250 |
| Fiber diameter (μm) | 3 ± 2 μm | 15 ± 5 μm | — |

The diffuser 1 of the Example and the diffuser of the Comparative example were respectively attached to aeration systems in two test pools (Test 1 and Test 2), which had been filled with 100 liters of tap water. The two pools were aerated for 10 min at an air flow rate of 30 L/min by a blower. The ambient temperature during the experiment was 28.8° C. The oxygen concentrations in the water were detected before aeration and after aeration, respectively, and the results of such detection are set forth in Table 2.

TABLE 2

| | oxygen concentration before aeration (mg/L) | oxygen concentration after aeration (mg/L) | increase of oxygen (mg/L) |
|---|---|---|---|
| Example | 4.56 | 7.87 | 3.31 |
| Comparative example | 5.17 | 7.18 | 2.01 |

Table 2 shows that, with the use of the diffuser 1 of the first embodiment of the present invention, the oxygen concentration in the test pool increases by 3.31 mg/L. In contrast thereto, use of the diffuser of the Comparative example resulted in an increase of the oxygen concentration in the test pool of only by 2.01 mg/L. Accordingly, the diffuser 1 of the present invention, when used in an aeration system, can significantly increase the dissolved oxygen concentration in water by 65%.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A diffuser for an aeration system, comprising a base which has a major wall with a periphery, and which defines a central line that is normal to said major wall, said major wall having an outer major surface and an inner major surface which is opposite to said outer major surface, and which defines an inlet that is adapted to introduce thereinto an aerating gas from the aeration system to generate a back pressure, and that extends along the central line through said outer major surface to form thereon a valve seat;

a valve member configured to engage said valve seat so as to close said inlet; and a diaphragm including, a central portion disposed to carry said valve member to place said diaphragm in a non-aerating position when said inlet is closed, a peripheral portion which surrounds said central portion, and which is secured to said periphery to form upstream and downstream sides separated by said diaphragm such that, when the back pressure at the upstream side is higher than an ambient pressure at the downstream side, said valve member is forced to move away from said valve seat to place said diaphragm in an aerating position, and a surrounding web segment which is interposed between said central portion and said peripheral portion, and which is configured to stay in abutment with said outer major surface in the non-aerating position, said surrounding web segment including a plurality of fibrous filaments which are arranged to form a textured structure with a plurality of pores of a dimension such that in the aerating position, the introduced aerating gas is permitted to be bubbled through said plurality of pores, and such that said abutment of said surrounding web segment with said outer major surface is sufficient to institute a barrier to guard against a back flow through each one of said pores immediately after the back pressure is set to drop below the ambient pressure.

2. A diffuser for an aeration system of claim 1, wherein said periphery of said diaphragm is surface-treated with a waterproof material.

3. A diffuser for an aeration system of claim 2, wherein said peripheral portion includes an annular frame which is made from a stiff material such that said surrounding web segment is in a state of tension within said annular frame, said diffuser further comprising a securing ring which is configured to mate with, and which is disposed to secure said annular frame to said periphery of said base.

4. A diffuser for an aeration system comprising a base which has a major wall with a periphery, and which defines a central line that is normal to said major wall, said major wall having an outer major surface and an inner major surface which is opposite to said outer major surface, and which defines an inlet that is adapted to introduce thereinto an aerating gas from the aeration system to generate a back pressure, and that extends along the central line through said outer major surface to form thereon a valve seat;

a valve member configured to engage said valve seat so as to close said inlet;

a diaphragm including a central portion disposed to carry said valve member to place said diaphragm in a non-aerating position when said inlet is closed, a peripheral portion which surrounds said central portion, and which is secured to said periphery to form upstream and downstream sides separated by said diaphragm such that, when the back pressure at the upstream side is higher than an ambient pressure at the downstream side, said valve member is forced to move away from said valve seat to place said diaphragm in an aerating position;

a surrounding web segment which is interposed between said central portion and said peripheral portion, and which is configured to stay in abutment with said outer major surface in the non-aerating position, said surrounding web segment including a plurality of fibrous filaments which are arranged to form a textured structure with a plurality of pores of a dimension such that in the aerating position, the introduced aerating gas is permitted to be bubbled through said plurality of pores, and such that said abutment of said surrounding web segment with said outer major surface is sufficient to institute a barrier to guard against a back flow through each one of said pores immediately after the back pressure is set to drop below the ambient pressure; and wherein said fibrous filaments of said surrounding web segment have a diameter in a range of 0.005 μm to 5 μm, and said formed textured structure is a non-woven structure which has a basis density in a range of 20-150 g/cm$^2$, and which has said plurality of pores with a mean size ranging from 1 to 20 μm.

5. A diffuser for an aeration system of claim 4, wherein said plurality of pores have a mean size ranging from 5 to 12 μm.

6. A diffuser for an aeration of claim 4, further comprising a reinforcement layer which is disposed to shield said diaphragm from the back pressure, and which has an auxiliary web segment that is configured to be superimposed upon said surrounding web segment, and that includes a plurality of macro-pores of such a dimension as not to interfere with the bubbling of the introduced aerating gas through said plurality of pores.

7. A diffuser for an aeration system of claim 6, wherein said auxiliary web segment of said reinforcement layer is made from a non-woven fabric which has a basis density in a range of 20-150 g/cm$^2$, and which has said plurality of macro-pores with a mean size ranging from 8 to 100 μm, said non-woven fabric being made of a fiber having a diameter in a range of 10 μm to 200 μm.

8. A diffuser for an aeration system of claim 7, wherein said plurality of macro-pores have a mean size ranging from 10 to 30 μm.

9. A diffuser for an aeration system of claim 8, wherein said valve member comprises a head portion which is disposed to secure said central portion to said reinforcement layer, and a stem portion which extends along the central line, and which is adapted to close said inlet by engaging with said valve seat.

* * * * *